US005782472A

United States Patent [19]

Brown

[11] Patent Number: 5,782,472

[45] Date of Patent: Jul. 21, 1998

[54] DEVICE FOR COMBINING A GAME OF CHANCE AND CRAPS

[75] Inventor: J. Breck Brown, 05326 Lake Shore Dr., Boyne City, Mich. 49712

[73] Assignees: Steven R. Pyykkonen, Leonard, Mich.; J. Breck Brown, Las Vegas, Nebr.; a part interest

[21] Appl. No.: 702,280

[22] Filed: Aug. 23, 1996

Related U.S. Application Data

[62] Division of Ser. No. 533,567, Sep. 25, 1995, abandoned.

[51] Int. Cl.[6] ..... A63F 1/00

[52] U.S. Cl. ..... 273/274; 273/309

[58] Field of Search ..... 273/274, 292, 273/309

[56] References Cited

U.S. PATENT DOCUMENTS

| | | | |
|---|---|---|---|
| 4,555,369 | 11/1985 | Johnson . | |
| 4,746,126 | 5/1988 | Angileri . | |
| 5,328,189 | 7/1994 | Malek | 273/309 |
| 5,540,444 | 7/1996 | Nguyen | 273/292 |
| 5,584,486 | 12/1996 | Franklin | 273/274 |
| 5,639,092 | 6/1997 | Macaisa | 273/292 |

*Primary Examiner*—William M. Pierce
*Attorney, Agent, or Firm*—Howard & Howard

[57] ABSTRACT

A method and game board are disclosed for combining the play of twenty-one based upon at least one card deck having fifty-two cards divided into four suites of duces through aces and the play of craps based upon two dice each having six faces numbered one to six. The board presents a semi-circular playing arena with a dealer playing area adjacent the straight diameter of the semi-circular playing arena and a plurality of player areas spaced about the circumference of the circular periphery of said semi-circular playing arena and opposed to the dealer playing area. Each of the player areas comprises a rectangular card box and a plurality of craps wager indicator circles dividing the numbers 2 through 12 into a plurality of groups for wagering at different odds for each group. After the wagers based upon the cards are settled, each player who has beaten the dealer with a blackjack is offered the roll of the dice and a craps wager on one of the craps wager circles. Before rolling the dice, the remaining players may also place bets on one of their respective craps wager circles. Each craps wager is then settled based the outcome of the roll of the dice.

2 Claims, 1 Drawing Sheet

DEVICE FOR COMBINING A GAME OF CHANCE AND CRAPS

This application is a divisional of U.S. Ser. No. 08/533,567 filed Sep. 25, 1995, now abandoned.

TECHNICAL FIELD

The subject invention relates to a combination card and dice game.

BACKGROUND ART

Various games are known in the prior art which combine standard playing cards and two dice. The U.S. Pat. No. 4,746,126 to Angileri discloses a game utilizing the attributes of craps with the play of cards wherein the play of the cards is dependent upon the throw of the dice. The U.S. Pat. No. 4,515,369 discloses a game combining the elements of craps and blackjack wherein the rules of blackjack apply to movement of game pieces as determined by the roll of the dice.

SUMMARY OF THE INVENTION

An amusement device for playing a wagering game with cards and dice comprising a presenter for positioning at least two cards for each player, and a craps wager indicator for each player to indicate the craps wager based upon the roll of two dice by each player having only two cards equaling twenty-one.

BRIEF DESCRIPTION OF THE DRAWINGS

Other advantages of the present invention will become readily appreciated as the same becomes better understood by reference to the following detailed description when considered in connection with the accompanying drawings wherein FIG. I discloses a game board illustrating the subject invention.

DETAILED DESCRIPTION OF PREFERRED EMBODIMENT

Figure 1:
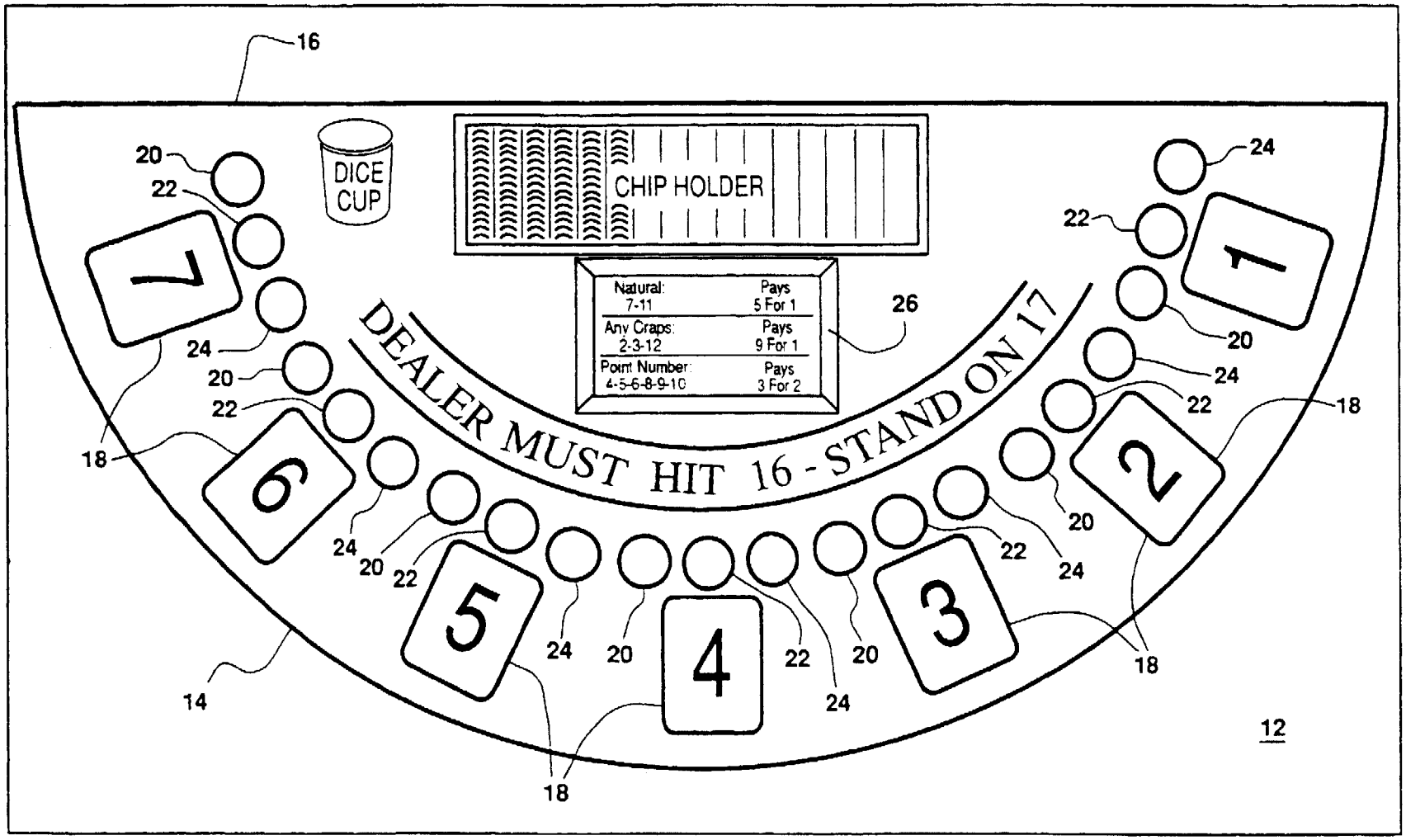

An amusement device for playing a wagering game with cards and dice is generally shown in FIG. 1. The device takes the form of a mat, table cloth or cover, place mat, or the like, and may even be implemented in a computer program producing images for a monitor. In any case the device comprises a presenter for positioning at least two cards for each player and a craps wager indicator for each player to indicate the craps wager based upon the roll of two dice by each player having only two cards equaling twenty-one.

As illustrated, the device is a game board generally indicated at 10 for combining aspects of the play of twenty-one based upon at least one card deck having fifty-two cards divided into four suites of duces through aces and aspects of the play of craps based upon two dice each having six faces numbered one to six. The board 10 comprises an upper playing surface 12 which presents a semi-circular playing arena, defined by the semi-circle 14 and the straight diameter 16. A dealer playing area is disposed adjacent the straight diameter 16 of the semi-circular playing arena. More specifically, the dealer playing area is in the area indicated by the indicia portraying the chip holder and chips. This is a dealer presentation area for presenting the dealer's cards.

The board also defines a plurality of player areas spaced about the circumference of the circular periphery 14 of the semi-circular playing arena and opposed to the dealer playing area. Each of the player areas comprises a rectangular card box 18 defining a player presentation area for each player to present the player cards. A plurality of craps wager indicator areas 20, 22 and 24 are disposed adjacent each player card rectangle 18 to divide the numbers 2 through 12 into a plurality of groups for wagering at different odds for each group. More specifically, a plurality of three craps wager indicators 20, 22 and 24 are presented for each player with each indicator presenting different odds for different total dice numbers. A first 20 of the indicators, i.e., indicator areas, presents the numerals 7 and 11 for first odds of five for one, a second 22 of the indicator areas presents the numerals 2, 3 and 12 for second odds of nine for one, and a third 24 of the indicator areas presents the remaining numbers for third odds of three for two.

The game board 10 presents an odds area 26 centrally located and indicating the first, second and third odds for the respective wager areas 20, 22 and 24. That is, the table pay-off odds of five chips for one chip bet on a natural 7 or 11, the second table pay-off odds of nine chips for one chip bet on craps 2, 3 or 12, and the third table pay-off odds of three chips for one chip bet on the point numbers 4, 5, 6, 8, 9 or 10. The first true odds are three and one half to one for a natural 7 or 11, the second true odds are eight to one for craps 2, 3 or 12, and the third true odds are one to two for point numbers 4, 5, 6, 8, 9 or 10. The board may include other informative indicia like the dealer must take a card when at sixteen in blackjack and stand at seventeen.

The invention, therefore, includes a method of combining the certain aspects of the play of twenty-one and craps comprising the basic steps of presenting at least two cards face up to each player followed by then offering a craps wager based upon the roll of two dice to a player having two cards with card indicia which together equal the sum of twenty-one, i.e., to each player having a blackjack. Each player having blackjack and beating the dealer then places a craps wager and rolls the dice; the wagers are then settled based upon the outcome of the roll of the dice. The offering of the craps wager includes the offer of a plurality of alternative dice number combinations in groups having different betting odds. More specifically, the offering of the wager combinations are divided into the dice number combinations of the natural 7 or 11 at first odds, the dice number combinations of any craps 2, 3 or 12 at second odds, and the remaining dice number combinations of the point numbers 4, 5, 6, 8, 9, or 10 at different third odds. For example, the numerals 7 and 11 may be at first odds of five for one, the numerals 2, 3 and 12 may be at second odds of nine for one, and the remaining numbers of 4, 5, 6, 8, 9, and 10 may be at third odds of three for two. Of course, these odds may vary as in accordance with individual house rules.

The play of twenty-one is based upon at least one card deck having fifty-two cards divided into four suites of duces through aces and the play of craps based upon two dice each having six faces numbered one to six. It involves the placing of a blackjack wager on behalf of each player to beat a dealer player by placing chips in front of the card boxes 18. The dealer, or machine, presents two cards to each player including the dealer player by placing the cards on the card boxes 18 in sequence about the semi-circle 14. As is normal in the game of blackjack, additional cards are sequentially presented to each player in response to a request for same from that player. Thereafter, the blackjack wagers are paid or settled in the absence of requests for additional cards. The opportunity or option to roll two dice is then presented to each player beating the dealer player with a blackjack consisting of only two cards equaling twenty-one. However, before the roll of the dice, each player establishes a craps wager, if the player wishes to participate, based upon the roll of the two dice by placing chips on one of the three circles 20, 22, or 24 to indicate the numbers and odds of the roll. The blackjack winner then rolls the dice once and each craps wager is settled based the outcome of the roll of the dice.

Accordingly, at one seating a player may play blackjack and qualify to further bet on a craps roll of the dice each time the dealer or machine is beaten with a blackjack.

The invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed:

1. A game board for combining the play of twenty-one and the play of craps, said board comprising:

an upper playing surface;

said playing surface defined by a straight diameter extending across a semi-circular playing arena;

means for rolling a pair of dice;

a dealer playing area adjacent the straight diameter of the semi-circular playing arena;

a plurality of player areas spaced about the circumference of the circular periphery of said semi-circular playing arena and opposed to said dealer playing area, each of said player areas comprising a card box and first, second and third craps wager indicator areas, said first indicator area including the numbers 7 and 11 for paying first odds in response to the roll of the dice matching 7 or 11, said second indicator area including the numbers 2, 3 and 12 for paying second odds in response to the roll of the dice matching 2, 3 or 12, and said third indicator area including the numbers the remaining numbers 4, 5, 6, 8, 9 and 10 for paying third odds in response to the roll of the dice matching 4, 5, 6, 8, 9 or 10, and an odds area indicating said first, second and third odds.

2. An amusement device for combining a game of chance and craps comprising;

a game of chance for one or more players to establish at least one winning player;

first, second and third craps wager indicators for each player;

said first indicator presents 7 and 11 for paying first odds in response to the roll of the dice matching 7 or 11, said second indicator presents 2, 3, and 12 for paying second odds in response to the roll of the dice matching 2, 3 or 12, and said third indicator presents 4, 5, 6, 8, 9 and 10 for paying third odds in response to the roll of the dice matching 4, 5, 6, 8, 9 or 10;

an odds indicia area for presenting said first, second and third odds; and means for rolling a pair of dice.

* * * * *